United States Patent [19]

Breitbach

[11] Patent Number: 4,747,178

[45] Date of Patent: May 31, 1988

[54] FIREPLACE CLEANING DEVICE

[76] Inventor: Kenneth P. Breitbach, 1526 W. 13th, Port Angeles, Wash. 98362

[21] Appl. No.: 56,718

[22] Filed: Jun. 1, 1987

Related U.S. Application Data

[63] Continuation-in-part of Ser. No. 773,180, Sep. 6, 1985, abandoned.

[51] Int. Cl.[4] ..... A47L 7/00

[52] U.S. Cl. ..... 15/339; 15/257 A; 15/338; 15/352

[58] Field of Search ..... 15/257 A, 310, 339, 15/352, 415 R; 126/242

[56] References Cited

U.S. PATENT DOCUMENTS

| | | | |
|---|---|---|---|
| 1,065,953 | 7/1913 | May | 126/242 |
| 1,355,508 | 10/1920 | Roever | 126/242 X |
| 1,898,887 | 2/1933 | Naul | 15/310 X |
| 2,013,498 | 9/1935 | McConaughy | 15/310 X |
| 4,360,947 | 11/1982 | De Casa et al. | 15/339 X |
| 4,497,308 | 2/1985 | Johnson | 15/327 F X |

*Primary Examiner*—Chris K. Moore

*Attorney, Agent, or Firm*—William I. Beach

[57] ABSTRACT

The fireplace cleaning device comprises a partial open ended container, substantially box-like in construction, for removing ashes from the hearth. A holding element is mounted on top of the container for supporting a portable vacuum device. The vacuum intake of the device has access to the interior for creating a draft therein when ashes are picked up and deposited therein. The removal of ashes is achieved with practically no spillage or the release of dust in the residence.

10 Claims, 1 Drawing Sheet

FIREPLACE CLEANING DEVICE

This application is a continuation-in-part of Ser. No. 773,180 filed Sept. 6, 1985, now abandoned.

BACKGROUND OF THE INVENTION

1. Field of the Invention

The present invention relates to receptacle devices for cleaning operations, and more particularly to the type used in combination with portable vacuum devices for removing ashes off of the fireplace hearth.

2. Description of the Prior Art

As far as applicant can determine there appears to be very few cleaning devices that can be used effectively to clean ashes off of a fireplace hearth without spilling ashes on the floor and stirring up a cloud of dust. There are several patents noted that suggests means for receiving ashes or dust. None, however, appear to disclose a device that can be used directly in the fireplace to lift ashes off of the hearth while using a vacuum to substantially control the dust arising therein. The problem of maintaining a clean fireplace is difficult and generally messy. Ashes are spilled on the living room carpet and dust tends to cover furniture and the like. The devices disclosed in the above-mentioned patents are mostly large or too complicated to function in a fireplace. Further, they are too expensive for such a simple operation.

In light of the above, it is the object of the present to provide a cleaning receptacle in combination with a small, portable vacuum device that will solve the aforementioned problems. The present invention incorporates the struction and effective means for removing ashes from the fireplace hearth. It can be manufactured readily and inexpensively.

SUMMARY OF THE INVENTION

In carrying out the principles of the present invention in accordance with a preferred embodiment thereof a cleaning receptacle in combination with a portable vacuum device is adapted to remove and deposit ashes in a container placed on a fireplace hearth. The container for receiving ashes has a pair of spaced side panels, a top and bottom panel, a closed rear end panel and a front end having a closed partial upper panel and an open lower portion. In the top panel is a first small opening adjacent to the front end extending through the top panel. An interior panel extends from a connection to the lower lateral edge of the partial panel rearwardly between the top and bottom panels. Included is a holding member mounted on the top panel that has a second opening disposed over the first opening. Supported in the holding member is a portable vacuum device wherein the vacuum intake is positioned over the first and second openings. The container is placed on the hearth, with the vacuum device turned on, and ashes are brushed or scooped up into the front opening. Any dust arising therefrom is substantially drawn into the container.

DETAILED DESCRIPTION OF THE PREFERRED INVENTION

Figure 1:
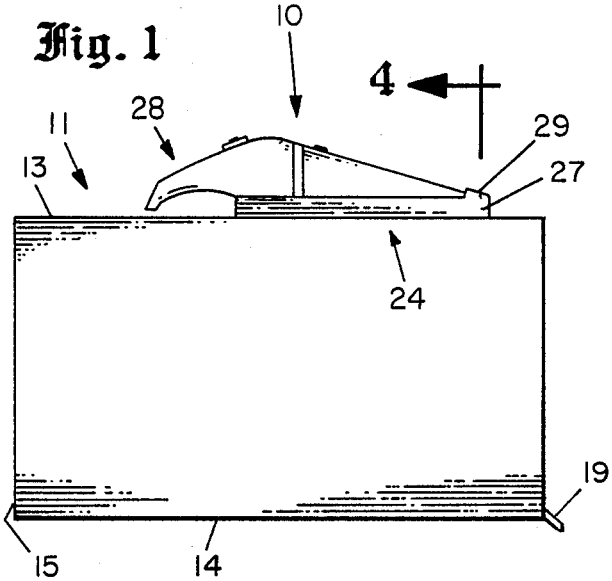
FIG. 1, is a side elevational view of the present invention showing the cleaning receptacle together with a portable vacuum device mounted on top.
Figure 2:
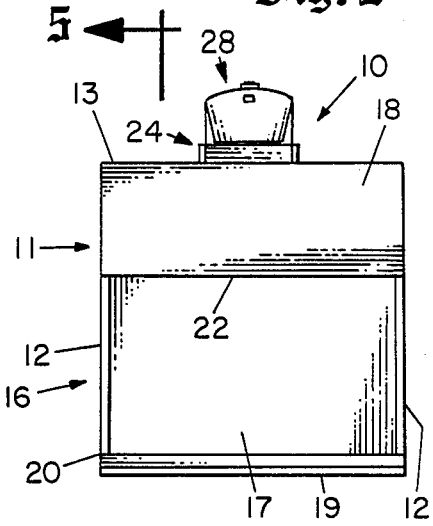
FIG. 2, shows the elevational view of the front end with the upper portion closed and the lower open.
Figure 3:
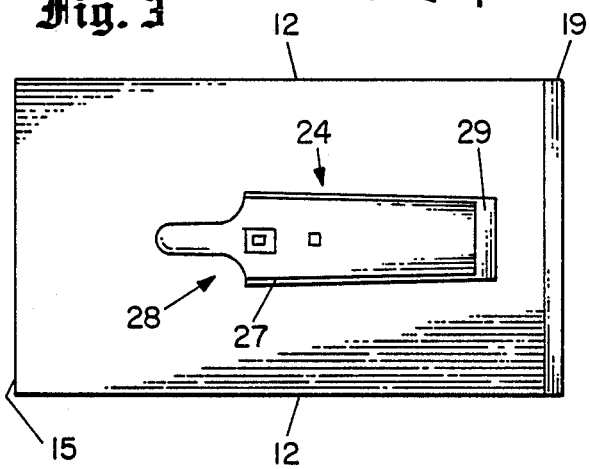
FIG. 3, is a plan view of the present invention with the vacuum device mounted on top.
Figure 4:
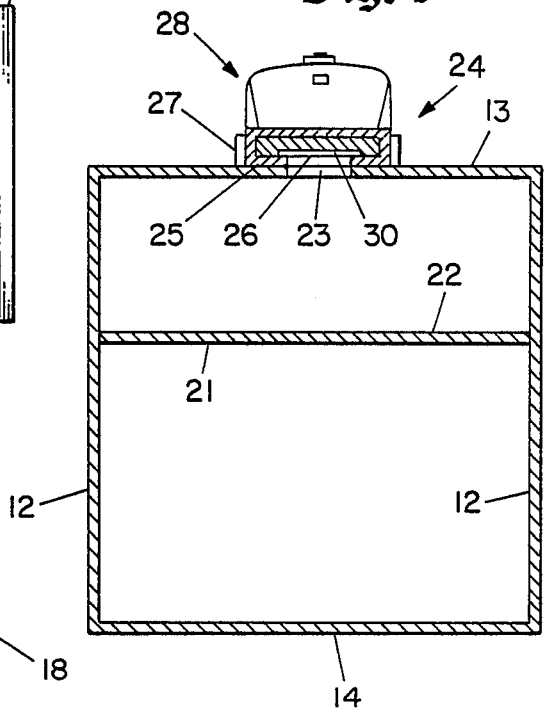
FIG. 4, is an enlarged interior view of FIG. 1, taken along line 4—4.
Figure 5:
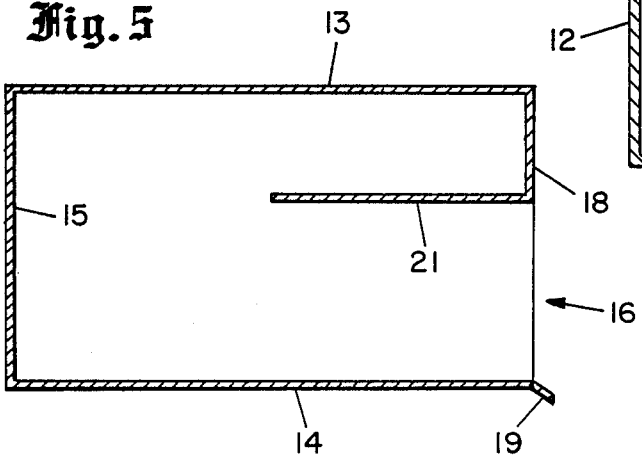
FIG. 5, is an interior view of FIG. 2, taken along line 5—5.

Referring to FIGS. 1–4 it can be seen that the fireplace cleaning receptacle 10 consists of a container. Included is a holding member secured to the top of the container. The container and holding member are arranged to operate as a fireplace cleaning implement in combination with a portable, battery operated vacuum device supported in the member.

Container 11 is essentially box-shaped and consists of a pair of side panels 12 edge connected to a top panel 13 and bottom panel 14. The rear end is closed by panel 15. The front end 16 has an open bottom portion 17 and a closed top portion faced by a partial panel 18. A small lip 19 connected to the bottom lateral edge 20 of open portion 17 extends forwardly and downwardly. The lip 19 provides a dust pan type edge for scooping up ashes. When laying on the hearth the bottom of the container slants slightly upward at the front opening which tends to pile ashes toward the rear end when shoved into a mound of ashes.

In the interior of container 11 is a horizontal extending panel 21 having an outer end connected to the bottom lateral edge 22 of partial panel 18. The panel 21 stretches rearwardly for a distance approximately ½ of the length between the front and rear ends of the container. Further, panel 21 separates the air space in container 11 of approximately ⅓ above the panel and ⅔ below.

On the top panel 13 is a slotted opening 23 that provides access to the interior of container 11. Opening 23 extends laterally for a distance of approximately three inches across the top adjacent to front end 16. Secured to top panel 13 is a holding member 24. The bottom 25 of the holding member has an opening 26 similar to opening 23 in top panel 13 and is disposed directly above. Surrounding the base of bottom 25 is an upstanding rail 27 between which a portable vacuum device 28 is supported. In the forward end of railing 27 there is a hooded extension of the rail containing the nose portion and vacuum intake opening 30 of vacuum device 28. In this portion intake 30 is in registry with openings 23 and 26 and in communication with the interior of container 11.

Preferably, the vacuum device is the type that can be rechargeable and commercially available. This type is suggested for use in vacuuming automobiles.

The normal procedure for removing ashes from the fireplace is with a shovel or brush and a pan. The ashes are then deposited in a pail, or the like for disposal elsewhere. Some ashes are frequently spilled on the floor and minute particles of ash dust tends to float out into the room to settle on the carpet, furniture and the like. The present invention provides the means to largely curtail the dust problem and may well contain all of the dust within the fireplace if the movement of the container is applied carefully to scoop-up ashes with the least amount of disturbance of the pile. It is to be clearly understood that while it is preferable to use the present invention within the fireplace, it could be used outside to pour ashes into the container with excellent results.

In operating the present invention the container 11 is placed on the hearth with lip 19 at the edge of the pile of ashes. With the vacuum device 28 mounted in the holding member 24 the switch is turned on to create a vacuum within container 11. The movement of air above the horizontal panel 21 results in a swirling air movement below the panel and a corresponding draft inward through the opening in container 11. The container can then be pushed slowly into the pile of ashes in a scoop-up movement to deposit it in the rear of the container while the dust settles therein and in the fireplace. The ashes can also be brushed slowly into the container and, likewise, the dust will settle within the fireplace. In either case, however, with the container full of ashes, and the vacuum still operating it can be carried through the residence with no spillage of ashes or release of dust for depositing outdoors.

From the description and illustration of the present invention, it is obvious that it fills the need for cleaning the fireplace hearth and practically eliminates spillage of ashes and the settlement of dust in the living room. Further, it eliminates the general practice of shovelling ashes from the fireplace into a bucket or pan resting on the living room floor.

The foregoing description is to be clearly understood to be given by way of illustration and example only, the spirit and scope of the present invention being limited solely by the appended claims.

I claim:

1. A cleaning receptacle for removing ashes off of a fireplace hearth in combination with a portable vacuum device mounted thereon, which comprises:

a container for receiving ashes having spaced side panels, a top and bottom panel, a rear end panel and a front end open at the bottom portion with a partial front panel closing the top portion, a small first opening extending through the top panel adjacent to the front end, an inner horizontal panel connected at the outer end edge to the bottom lateral edge of the partial panel, and an inner end extending rearwardly between said top panel and the bottom panel, a holding member mounted on said top panel with a bottom second opening disposed over the first opening, the holding member being adapted to support a portable vacuum device having a vacuum intake opening in registry with said first opening and the second opening in communication with the container interior, and means for removing the ashes from a fireplace with said container adapted to engage a mound of ashes for depositing therein and, in cooperation with the vacuum of the vacuum device, suppress a substantial amount of dust arising therewith.

2. A cleaning receptacle as recited in claim 1, wherein:

said partial panel is connected to the front edges of said top and the side panels and extends downwardly for a distance less than the distance the front end opening extends upwardly.

3. A cleaning receptacle as recited in claim 1, wherein:

the inner panel stretches rearwardly for a distance equal to approximately the distance between said top and bottom panels.

4. A cleaning receptacle as recited in claim 1, wherein:

the holding member includes perpheral railing around the bottom of said member and a hood-like portion adapted to enclose the front intake nose section of said vacuum device.

5. A cleaning receptacle for removing ashes off a fireplace hearth in combination with a portable vacuum device mounted thereon, which comprises:

an elongated, rectangular container for holding ashes constructed of spaced parallel side panels, a top and bottom panel, a rear end panel, and a front end opened at the bottom including a partial front panel closing the top portion, a slotted first opening extending through the top panel parallel and adjacent to the front end for entry to the container, an interior panel forming an extension of the partial panel folded inwardly and rearwardly at the bottom lateral edge of said partial panel for providing a divided air space within said container, a holding member secured to said top panel including a second bottom opening in alignment with the first opening, having a portable vacuum device supported thereon with a vacuum intake opening over said first and second openings for providing a suction motion in the interior of said container, means for removing the ashes in a fireplace with said container, said container being adapted to receive said ashes therein and, with the vacuum from the vacuum device supported thereon, suppress a substantial amount of dust particles disturbed by the movement of said ashes.

6. A cleaning receptacle as recited in claim 5, wherein: the interior panel extends a distance of approximately $\frac{1}{2}$ the distance from said front end to the rear end of said container.

7. A cleaning receptacle as recited in claim 6, wherein:

said interior panel side edges are not attached to the interior surface of the side panels and separates the air space therein by $\frac{1}{3}$ for the upper and $\frac{2}{3}$ for the bottom space.

8. A cleaning receptacle as recited in claim 5, wherein:

the holding member has an upstanding rim secured around the bottom edge to engage and support said vacuum device including a front cover connected to the upper edge of the rim so that the vacuum intake opening is in communication with said container interior through said second and first openings.

9. A cleaning receptacle as recited in claim 5, wherein:

said means for removing ashes further includes a lateral, scoop-like lip extending forewardly and downwardly along the bottom edge of said front end.

10. A cleaning receptacle as recited in claim 5, wherein:

when said container is carefully shoved into a mound of ashes and tipped upwardly to deposit said ashes in the rear of said container with the vacuum of the vacuum device turned on, said receptacle can be transported safely outdoors.

* * * * *